US007088318B2

(12) United States Patent
Malmberg

(10) Patent No.: US 7,088,318 B2
(45) Date of Patent: Aug. 8, 2006

(54) SYSTEM AND METHOD FOR COMPENSATION OF ACTIVE ELEMENT VARIATIONS IN AN ACTIVE-MATRIX ORGANIC LIGHT-EMITTING DIODE (OLED) FLAT-PANEL DISPLAY

(75) Inventor: Paul R. Malmberg, Pittsburgh, PA (US)

(73) Assignee: Advantech Global, Ltd., Tortola (VG)

( * ) Notice: Subject to any disclaimer, the term of this patent is extended or adjusted under 35 U.S.C. 154(b) by 0 days.

(21) Appl. No.: 10/970,382

(22) Filed: Oct. 22, 2004

(65) Prior Publication Data

US 2006/0087247 A1 Apr. 27, 2006

(51) Int. Cl.
*G09G 3/30* (2006.01)
*G09G 3/10* (2006.01)

(52) U.S. Cl. ..... 345/77; 315/169.1

(58) Field of Classification Search ..... 345/77, 345/63, 690, 169.1, 82
See application file for complete search history.

(56) References Cited

U.S. PATENT DOCUMENTS 5,886,474 A * 3/1999 Asai et al. ..... 315/169.1
5,923,309 A * 7/1999 Ishizuka et al. ..... 345/82
6,351,078 B1 2/2002 Wang et al. ..... 315/169.3
6,414,661 B1 7/2002 Shen et al. ..... 345/82
6,724,149 B1 4/2004 Komiya et al. ..... 315/169.3
6,885,356 B1 * 4/2005 Hashimoto ..... 345/77
2002/0030647 A1 * 3/2002 Hack et al. ..... 345/82
2004/0051685 A1 * 3/2004 Chung et al. ..... 345/82
2005/0007320 A1 * 1/2005 Smith et al. ..... 345/77
2005/0280766 A1 * 12/2005 Johnson et al. ..... 349/167

FOREIGN PATENT DOCUMENTS

JP 02003308046 A * 10/2003

* cited by examiner

*Primary Examiner*—Thuy V. Tran
*Assistant Examiner*—Angela M Lie
(74) *Attorney, Agent, or Firm*—Dickstein Shapiro LLP

(57) ABSTRACT

A brightness compensation system and method of providing brightness uniformity in an active-matrix organic light-emitting diode (OLED) flat-panel display. The brightness compensation system of the present invention includes a system controller, a timing generator, a test brightness generator, a pixel address generator, a video formatter, a first and second multiplexer, a memory device, a pixel adjust device, a level shifter and driver, a current sensor, an analog-to-digital converter, a DC power supply, and an active-matrix OLED display under test. The brightness compensation system and method of the present invention subjects an active-matrix OLED display to a testing operation that alternately tests every pixel, detects its output current, which is an indicator of light output level, for a given input voltage, saves the output current value in memory, then applies a corrective voltage to each pixel, so that each pixel has the same light output (output current) as its neighboring pixel.

10 Claims, 5 Drawing Sheets

SYSTEM AND METHOD FOR COMPENSATION OF ACTIVE ELEMENT VARIATIONS IN AN ACTIVE-MATRIX ORGANIC LIGHT-EMITTING DIODE (OLED) FLAT-PANEL DISPLAY

FIELD OF THE INVENTION

The present invention relates to an organic light-emitting diode (OLED) flat-panel display. In particular, this invention relates to a system for and method of providing brightness uniformity in an active-matrix OLED flat-panel display.

BACKGROUND OF THE INVENTION

The circuit structure of an active-matrix OLED display, in which a plurality of pixels are arranged in rows and columns, is widely known. Each pixel includes two thin film transistors (TFTs), i.e., an addressing (or switching) transistor and a driving (or power) transistor, a storage capacitor, and an OLED device.

As is well known, in the conventional active-matrix OLED panel circuit, a scan line (row line) is selected, a video signal loaded in a data line (column line) is input to the driving transistor via the addressing transistor to control the current through the OLED device. The video signal is stored in the storage capacitor for the duration of one frame.

TFTs used in active-matrix OLED display panels are formed by use of amorphous silicon, polysilicon, or cadmium selenide (CdSe) through manufacturing processes such as photolithography or evaporation by use of a shadow mask technology. Threshold voltage variation in such a TFT, which may be caused by variations in the manufacturing process, leads to current non-uniformities between pixels and non-uniform brightness. These problems are not significant in small-screen applications, such as flat-panel displays in watches, telephones, laptop computers, pagers, mobile phones, calculators, and the like. However, in a large-screen display application, such as a flat-panel television, the display undergoes more serious threshold non-uniformities, and the quality of the display, such as brightness uniformity, is noticeably degraded.

The light output depends on several factors—(1) the uniformity of the power transistors at the time of manufacture, (2) the uniformity of the power transistors as they age, and (3) the stability of the medium itself that is being driven. Therefore, there is a technical challenge in ensuring that the power transistors that drive the OLEDs are uniform and, secondly, if they are not uniform, there is a technical challenge in correcting the non-uniformity. A need exists for a way to compensate the active-matrix power transistors so that they are uniform and, thus, the brightness of the active-matrix OLED display is uniform from pixel-to-pixel across the display.

An examplary circuit for compensating an active-matrix OLED display is found in reference to U.S. Pat. No. 6,414,661, entitled, "Method and Apparatus for Calibrating Display Devices and Automatically Compensating for Loss in their Efficiency Over Time." The '661 patent describes a method and associated system that compensates for long-term variations in the light-emitting efficiency of individual OLED in an OLED display device, calculates and predicts the decay in light output efficiency of each pixel, based on the accumulated drive current applied to the pixel, and derives a correction coefficient that is applied to the next drive current for each pixel. The present invention further provides a method for calibrating a display device formed of an array of individually adjustable discrete light-emitting devices (pixels) by use of a camera that has an array of radiation sensors or a single photodetector.

While the '661 patent describes a suitable method of providing compensation, it does so by using a complex process of capturing images of each pixel with a camera system. A need exists for a way to provide threshold voltage compensation to overcome brightness non-uniformity without a complex system.

One objective of the invention to provide an active-matrix OLED display that has uniform brightness from pixel-to-pixel across the full area of the display by overcoming brightness non-uniformity caused by irregularities of the manufacturing process.

Another objective of the invention to provide a simplified system for and method of compensating the brightness of a flat-panel on a pixel-by-pixel basis.

BRIEF SUMMARY OF THE INVENTION

The present invention is a brightness compensation system and method for providing brightness uniformity in an active-matrix OLED flat-panel display. The present invention anticipates the use of control and memory circuits built into the interface circuitry of an active-matrix display that uses a current-dependent, light-emitting medium to completely compensate for inconsistencies in the threshold voltage and gain of the active elements (thin film transistors), both in the display and in the peripheral row and column addressing circuits. Because the measurement and corrective functions are built into the display interface circuitry, the corrective sequence, which may last as little as a few seconds, can be activated at any time, as required. For example, the corrective sequence may be automatically activated every time the display power is cycled; or, alternatively, the corrective sequence may be automatically activated on any desired time interval, such as weekly, daily, or hourly. In this way, the present invention assures that each display element delivers the exact current at its output that is required by the brightness signal of the video input signal.

The brightness compensation system and method of the present invention subjects an active-matrix OLED display to a testing operation that alternately tests every pixel, detects its output current, which is an indicator of light output level, for a given input voltage, saves the output current value in memory, then applies a corrective voltage to each pixel, so that each pixel has the same light output as its neighboring pixel. The testing operation may be performed either one pixel at a time or "n" pixels at a time.

Other features and advantages of the present invention will become more apparent from the detailed description of exemplary embodiments provided below with reference to the accompanying drawings.

DETAILED DESCRIPTION OF THE INVENTION

Figure 1:
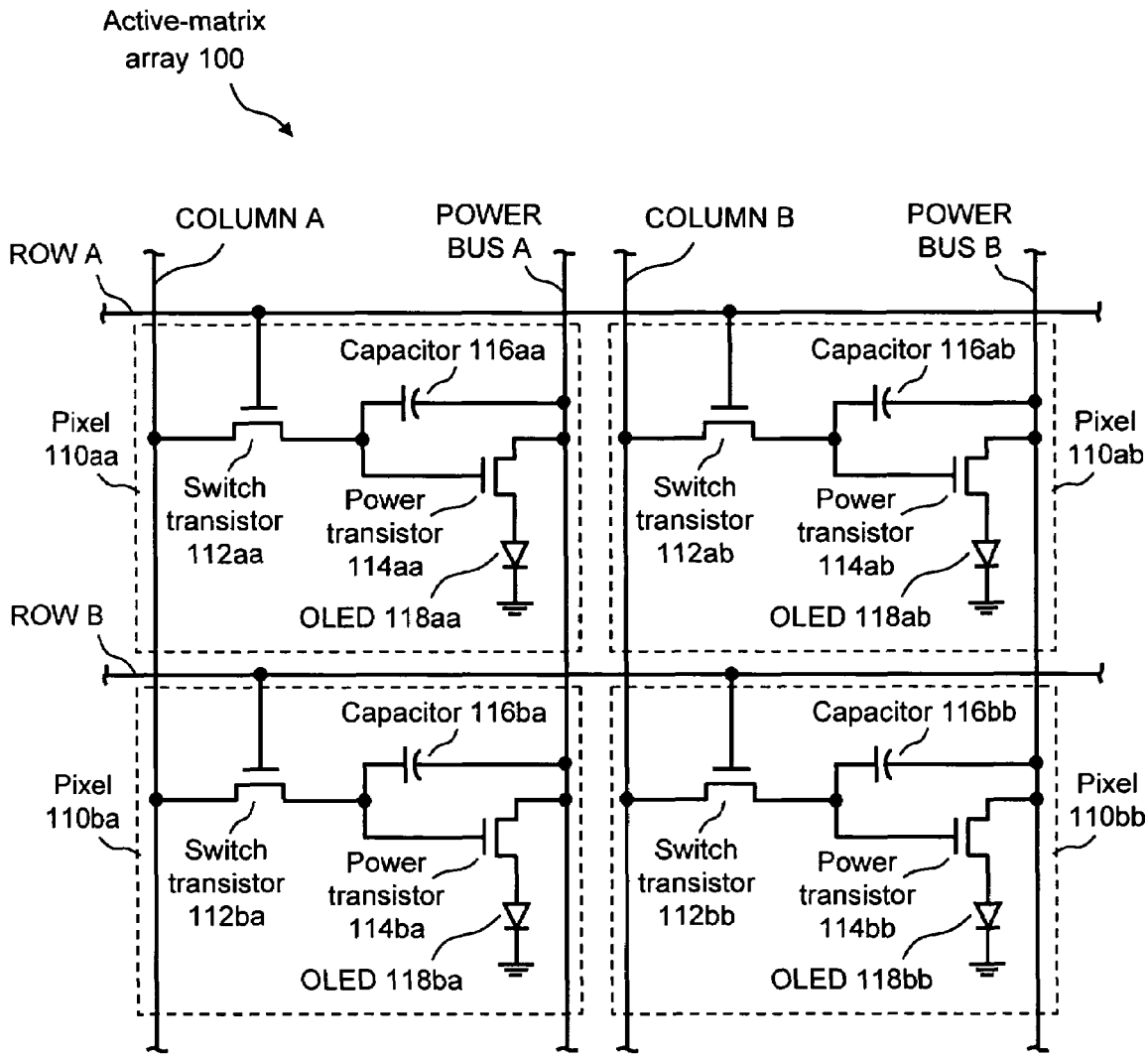
FIG. 1 illustrates an active-matrix array, which is representative of an exemplary portion of a larger active-matrix OLED flat-panel display.

FIG. 1 illustrates an active-matrix array 100, which is representative of an exemplary portion of a larger active-matrix OLED flat-panel display. In this example, active-matrix array 100 is a 2×2 array of pixels 110, i.e., a pixel 110*aa*, a pixel 110*ab*, a pixel 110*ba*, and a pixel 110*bb*, which are addressed via pulsed signals applied to a ROW A and a ROW B and via voltage levels applied to a COLUMN A and a COLUMN B. Power is supplied to pixels 110*aa*, 110*ab*, 110*ba*, and 110*bb* via a POWER BUS A and a POWER BUS B. Each pixel 110 is formed by a standard active-matrix electrical circuit that includes a switch transistor 112, a power transistor 114, a capacitor 116, and an OLED 118. In this example, pixel 110*aa* includes a switch transistor 112*aa*, a power transistor 114*aa*, a capacitor 116*aa*, and an OLED 118*aa*; pixel 110*ab* includes a switch transistor 112*ab*, a power transistor 114*ab*, a capacitor 116*ab*, and an OLED 118*ab*; pixel 110*ba* includes a switch transistor 112*ba*, a power transistor 114*ba*, a capacitor 116*ba*, and an OLED 118*ba*; and pixel 110*bb* includes a switch transistor 112*bb*, a power transistor 114*bb*, a capacitor 116*bb*, and an OLED 118*bb*.

The arrangement of the electrical components of each pixel 110 is described with reference to pixel 110*aa* as follows. The gate of switch transistor 112*aa* is connected to ROW A, the source of switch transistor 112*aa* is connected to COLUMN A, and the drain of switch transistor 112*aa* is connected to the gate of power transistor 114*aa*. The drain of power transistor 114*aa* is connected to POWER BUS A and the source of power transistor 114*aa* is connected to the anode of OLED 118*aa*. The cathode of OLED 118*aa* is connected to ground. Lastly, one side of capacitor 116*aa* is connected at the node between the drain of switch transistor 112*aa* and the gate of power transistor 114*aa*. The opposing side of capacitor 116*aa* is connected to any fixed voltage node; in this example, capacitor 116*aa* is connected to POWER BUS A. The arrangement of the electrical components of pixels 110*ab*, 110*ba*, and 110*bb* is identical, except for their connections to their respective ROW, COLUMN, and POWER BUS.

The operation of each pixel 110 of active-matrix array 100 is described with reference to pixel 110*aa* as follows. A power supply voltage in the range of, for example, +5 to +20 volts is applied to POWER BUS A. To activate OLED 118*aa*, a steady state voltage in the range of, for example, +2 to +15 volts, which corresponds to a desired brightness level, is applied at COLUMN A. Subsequently, a pulsed signal is applied to ROW A, which momentarily closes switch transistor 112*aa* and, thus, the voltage level at COLUMN A is transferred to the drain of switch transistor 112*aa*, and, subsequently to the gate of power transistor 114*aa*. As a result, power transistor 114*aa* is switched on, and the voltage present at POWER BUS A is transferred therethrough and activates OLED 118*aa*. Furthermore, as capacitor 116*aa* is connected between the gate power transistor 114*aa* and POWER BUS A, capacitor 116*aa* is charged with the voltage level present at COLUMN A. Subsequently, capacitor 116*aa* serves as a storage device for storing the voltage potential received from COLUMN A, even after the pulsed signal from ROW A is ended and switch transistor 112*aa* is opened. Via capacitor 116*aa*, a charge remains upon the gate of power transistor 114*aa* and, thus, power transistor 114*aa* is held on, which in turn holds OLED 118*aa* in an active state, i.e., emitting light. Conversely, OLED 118*aa* is turned off when zero volts is applied to COLUMN A and, subsequently, when a signal pulse is applied at ROW A to switch off power transistor 114*aa*, which deactivates OLED 118*aa*, and to discharge capacitor 116*aa*. Zero volts is stored upon capacitor 116*aa* and, thus, power transistor 114*aa* is held off and OLED 118*aa* is held in the inactive state, even after the signal pulse at ROW A is ended and switch transistor 112*aa* is opened.

In like manner, OLED 118*ab* is turned on or off when a positive voltage or zero volts is applied, respectively, to COLUMN B, when a positive supply voltage is applied to POWER BUS B, and then when a signal pulse is applied at ROW A; OLED 118*ba* is turned on or off when a positive voltage or zero volts is applied, respectively, to COLUMN A, when a positive supply voltage is applied to POWER BUS A, and then when a signal pulse is applied at ROW B; and OLED 118*bb* is turned on or off when a positive voltage or zero volts is applied, respectively, to COLUMN B, when a positive supply voltage is applied to POWER BUS B, and then when a signal pulse is applied at ROW B.

Because power transistors 114*aa*, 114*ab*, 114*ba*, and 114*bb* are analog devices, the current flowing therethrough is dependent on the voltage that is applied to their gates, which is supplied via the COLUMN lines. Furthermore, the brightness of OLEDs 118*aa*, 118*ab*, 118*ba*, and 118*bb* is determined by the current supplied by power transistors 114*aa*, 114*ab*, 114*ba*, and 114*bb*, respectively. Consequently, the uniformity of the performance characteristics of power transistors 114*aa*, 114*ab*, 114*ba*, and 114*bb* directly impacts the brightness uniformity of OLEDs 118*aa*, 118*ab*, 118*ba*, and 118*bb*, with respect to one another.

Figure 2:
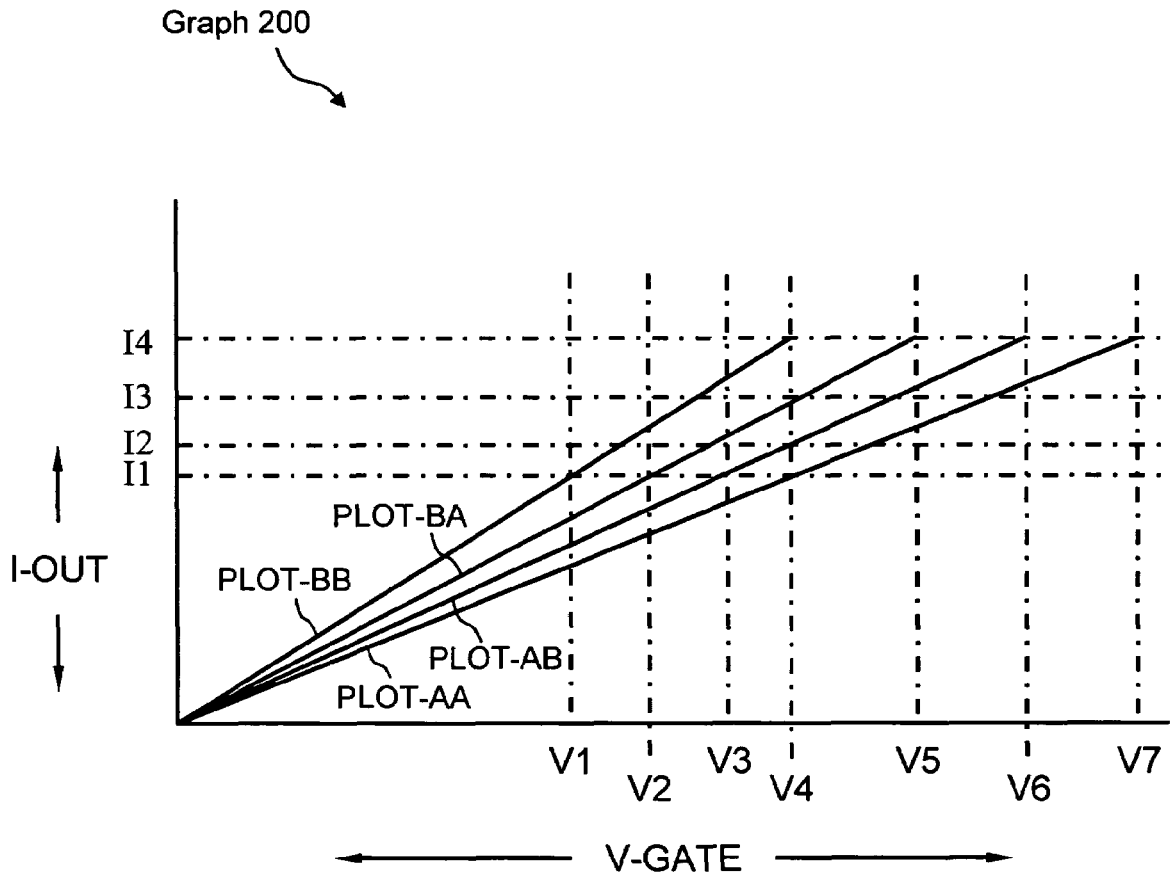
FIG. 2 shows a graph that illustrates example plots of pixel output current (I-OUT) vs. the applied gate voltage of the power transistor (V-GATE), which determines the brightness of the pixel.

FIG. 2 shows a graph 200 that illustrates example plots of pixel output current (I-OUT) vs. the applied gate voltage of the power transistor (V-GATE), which determines the brightness of the pixel. More specifically and with reference to FIGS. 1 and 2, the I-OUT vs. V-GATE of OLEDs 118*aa*, 118*ab*, 118*ba*, and 118*bb* is, for example, a PLOT-AA, a PLOT-AB, a PLOT-BA, and a PLOT-BB, respectively. For the purpose of illustration, PLOT-AA, PLOT-AB, PLOT-BA, and PLOT-BB represent differing performance characteristics (not to scale) of pixels 110*aa*, 110*ab*, 110*ba*, and 110*bb* of active-matrix array 100. In this example, along the V-GATE axis of graph 200, V-GATE is increasing from V1 to V7. Along the I-OUT axis of graph 200, I-OUT is increasing from I1 to I4. PLOT-BB shows that OLED 118*bb* of pixel 110*bb* is the highest performing pixel by comparison and PLOT-AA shows that OLED 118*aa* of pixel 110*aa* is the lowest performing pixel by comparison. PLOT-AB and PLOT-BA perform at an intermediate level by comparison. More specifically, PLOT-BB shows that, at a given V-GATE, V4, OLED 118*bb* provides the highest I-OUT, I4, by comparison. By contrast, in order for OLED 118*aa* to achieve the same I-OUT, I4, which corresponds to the same brightness level as OLED 118*bb*, the V-GATE of OLED 118*aa* is set to a higher level, V7. Similarly, the V-GATE of OLED 118*ab* and OLED 118*ba* must be set to V6 and V5, respectively, in order to achieve the same I-OUT, I4, and, thus, the same brightness level as OLED 118*bb*, which is operating at V4.

Because the relationship of I-OUT to the brightness level of an OLED device is essentially proportional, there are two approaches to providing uniform brightness across an array of OLEDs that form a flat-panel display:

1. Determine the highest performing pixel (highest I-OUT, i.e., highest brightness level, for a given V-GATE) in the array and then adjust upward the V-GATE voltage of all the lesser performing pixels, until the I-OUT of all the lesser performing pixels matches the I-OUT of the highest performing pixel. For example, and with reference to FIGS. 1 and 2, if OLED 118*bb* (PLOT-BB) represents the highest performing pixel, which provides an I-OUT of I4 with V-GATE set at V4, then V-GATE for OLED 118*aa* (PLOT-AA) is set at V7, V-GATE for OLED 118*ab* (PLOT-AB) is set at V6, and V-GATE for OLED 118*ba* (PLOT-BA) is set at V5, in order to achieve an I-OUT of I4.

2. Determine the lowest performing pixel (lowest I-OUT, i.e., lowest brightness level, for a given V-GATE) in the array and then adjust downward the V-GATE voltage of all the higher performing pixels, until the I-OUT of all the higher performing pixels matches the I-OUT of the lower performing pixel. The method assumes that the lower performing pixel is performing at an acceptable brightness level. For example, and with reference to FIGS. 1 and 2, if OLED 118*aa* (PLOT-AA) represents the lowest performing pixel, which provides an I-OUT of I1 with V-GATE set at V4, then V-GATE for OLED 118*ab* (PLOT-AB) is set at V3, V-GATE for OLED 118*ba* (PLOT-BA) is set at V2, and V-GATE for OLED 118*bb* (PLOT-BB) is set at V1, in order to achieve an I-OUT of I1.

The first method of providing brightness uniformity, as described above, is the less desirable technique, because, first, increasing V-GATE for all the lesser performing pixels causes an increase in the overall power consumption of the active-matrix OLED flat-panel display. Second, decreasing the power is somewhat easier to implement in a signal processing system. Consequently, the second technique of decreasing V-GATE to match the lowest performing pixel is more desirable (assuming that the lowest performing pixel is performing at an acceptable brightness level). Therefore, a system and method for compensating the brightness of an active-matrix OLED flat-panel display according to this second technique is provided in reference to FIGS. 3 and 4 in accordance with the invention.

Figure 3:
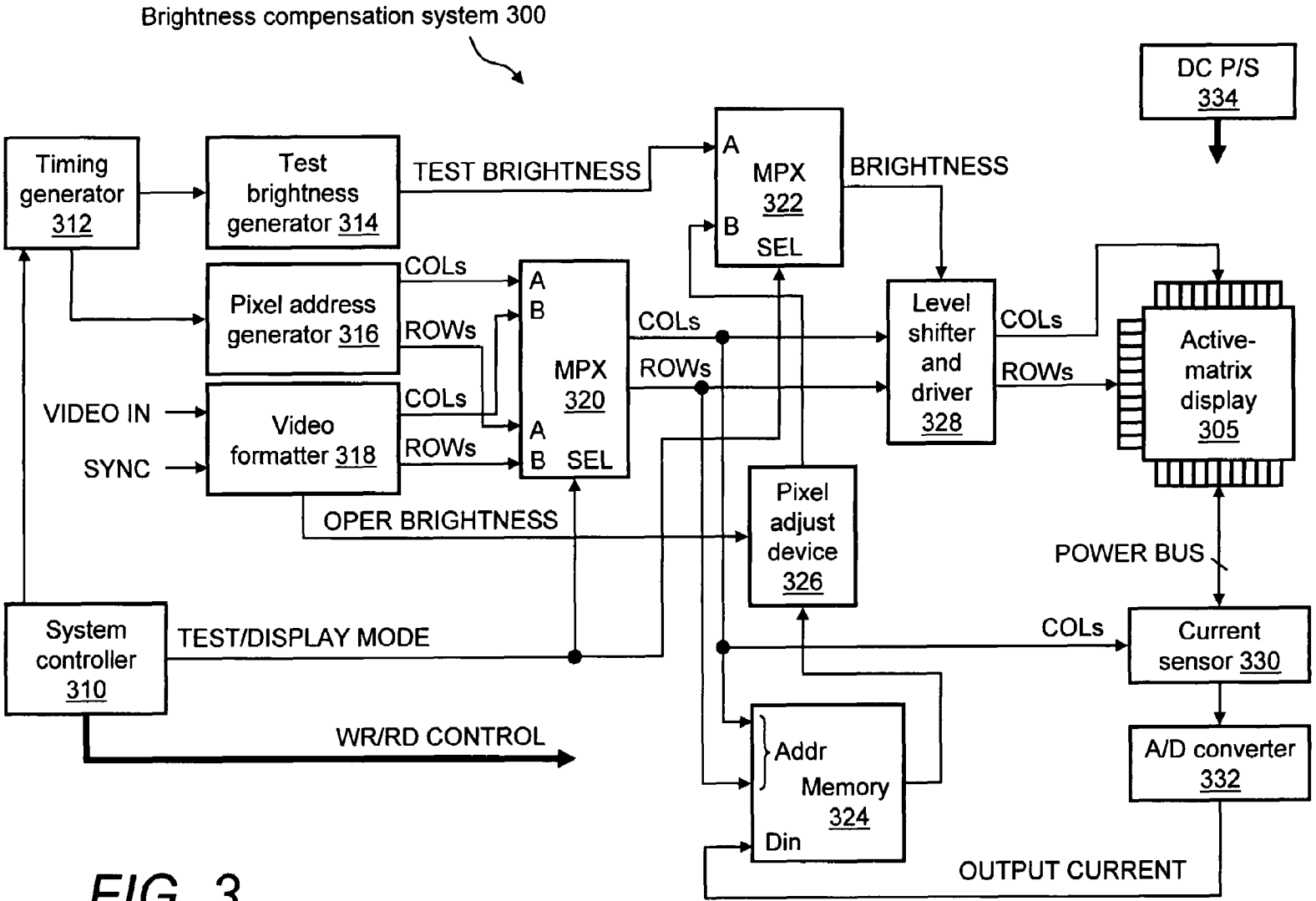
FIG. 3 illustrates a functional block diagram of a brightness compensation system for providing brightness uniformity within an active-matrix OLED flat-panel display in accordance with a first embodiment of the invention.

FIG. 3 illustrates a functional block diagram of a brightness compensation system 300 for providing brightness uniformity within an active-matrix OLED flat-panel display in accordance with a first embodiment of the invention. Brightness compensation system 300 is built into the display interface circuitry of an active-matrix display 305, which is representative of a typical active-matrix OLED display under test. Brightness compensation system 300 includes a system controller 310, a timing generator 312, a test brightness generator 314, a pixel address generator 316, a video formatter 318, a multiplexer (MPX) 320, an MPX 322, a memory 324, a pixel adjust device 326, a level shifter and driver 328, a current sensor 330, an analog-to-digital (A/D) converter 332, and a DC power supply (P/S) 334.

System controller 310 is representative of a standard microprocessor device, such as a Philips 8051 8-bit microcontroller or a Motorola 6816 16-bit microcontroller. Alternatively, system controller 310 is an external processor, such as a personal computer or networked computer. System controller 310 is loaded with software for managing the operation and communication functions of brightness compensation system 300. For example, system controller 310 manages the write and read operations of, for example, memory 324. Furthermore, system controller 310 provides a mode select signal for switching between a DISPLAY MODE and a TEST MODE. DISPLAY MODE is a mode setting of brightness compensation system 300 wherein active-matrix display 305 is in a normal operating mode and is, thus, receiving its picture and brightness information via typical video input signals. By contrast, TEST MODE is a mode setting of brightness compensation system 300 wherein a brightness compensation operation is performed upon active-matrix display 305 via an alternative source of picture and brightness information. The operation of brightness compensation system 300 in DISPLAY MODE and TEST MODE is further described below.

In TEST MODE, timing generator 312 is a clock generator that supplies the main timing signals to test brightness generator 314 and pixel address generator 316 for clocking out a set of timed signals therefrom. More specifically, in TEST MODE, pixel address generator 316 generates a set of column and row address outputs that are timed according to the clock from timing generator 312. Likewise, in TEST MODE, test brightness generator 314 generates a digitized test brightness value, i.e., a TEST BRIGHTNESS output, for each unique column and row address generated by pixel address generator 316. The digitized TEST BRIGHTNESS output of test brightness generator 314 is timed according to the clock from timing generator 312. As a result, test brightness generator 314 and pixel address generator 316 are the brightness and picture information sources, respectively, for active-matrix display 305 in the TEST MODE of operation.

In DISPLAY MODE, video formatter 318 supplies the brightness and picture information to active-matrix display 305. More specifically, video formatter 318 receives VIDEO IN and SYNC signals from a standard video source, such as a television (not shown), and generates a set of column and row address outputs as well as a digitized brightness value, i.e., an OPERATING BRIGHTNESS output, for feeding active-matrix display 305.

MPX 320 and MPX 322 perform a standard 2-to-1 multiplexing function for steering column and row signals and brightness information, respectively, to active-matrix display 305 from either pixel address generator 316 and test brightness generator 314 in TEST MODE or, alternatively, from video formatter 318 in DISPLAY MODE. The inputs to MPX 320 are the column and row signals from pixel address generator 316 and the column and row signals from video formatter 318. The output of MPX 320 is a set of column select signals (COLs) and a set of pulsed row signals (ROWs). The inputs to MPX 322 are the digitized TEST BRIGHTNESS information from test brightness generator 314 and a digitized brightness value from pixel adjust device 326. The output of MPX 322 is a digitized BRIGHTNESS output.

The COL and ROW outputs from MPX 320 and the BRIGHTNESS output from MPX 322 feed the input of level shifter and driver 328. Level shifter and driver 328 shifts the ROW signals to a predetermined analog voltage level and includes a set of drivers for driving the ROW inputs of active-matrix display 305. Additionally, level shifter and driver 328 shifts the COL select signals to an analog voltage level according to the brightness information received upon the BRIGHTNESS input signal. Level shifter and driver 328 includes a set of drivers for driving the analog COL inputs of active-matrix display 305. The analog voltage levels upon the COL inputs of active-matrix display 305 determine the brightness level of each pixel within active-matrix display 305. With reference to FIG. 1, if active-matrix array 100 is a portion of active-matrix display 305, the ROW inputs of active-matrix display 305 are, for example, ROW A and ROW B of active-matrix array 100 and the COL inputs of active-matrix display 305 are, for example, COLUMN A and COLUMN B of active-matrix array 100.

Current sensor 330 is any well-known current-sensing device that is electrically connected to the POWER BUS of active-matrix display 305. With reference to FIG. 1, if active-matrix array 100 is a portion of active-matrix display 305, the POWER BUS inputs/outputs of active-matrix display 305 are, for example, POWER BUS A and POWER BUS B of active-matrix array 100. Current sensor 330 is addressed by the COL signals from MPX 320 and, thus, is able to select and measure current of one POWER BUS line at a time, rather than measuring the current of all POWER BUS lines connected in parallel. An analog current measurement from current sensor 330 feeds A/D converter 332, which performs a well-known conversion function to convert the analog current measurement to a digitized current measurement value.

The digital output of A/D converter 332 feeds the data inputs of memory 324. The COL and ROW signals from MPX 320 feed the address inputs of memory 324. Memory 324 is any commercially available non-volatile or volatile readable/writable computer memory device, such as any standard FLASH memory or random access memory (RAM) device. The read/write operations of memory 324 are controlled via system controller 310. Memory 324 serves as local storage for the current measurement information specifically related to each pixel of active-matrix display 305.

Pixel adjust device 326 performs the arithmetic function of subtracting a digital value stored in memory 324 from the digitized OPERATING BRIGHTNESS value.

DC P/S 334 is a standard DC power supply that supplies a voltage in the range of, for example, +5 to +20 volts to the POWER BUS of active-matrix display 305.

With continuing reference to FIGS. 1, 2, and 3, the operation of brightness compensation system 300 to achieve brightness uniformity across all pixels within active-matrix display 305 is as follows. Under the control of system controller 310, brightness compensation system 300 is switched to the TEST MODE of operation, which places MPX 320 and MPX 322 in a state such that the source for the COL and ROW signals feeding level shifter and driver 328 is pixel address generator 316 and the source for the brightness information feeding level shifter and driver 328 is test brightness generator 314. The value of TEST BRIGHTNESS from test brightness generator 314 is set by system controller 310 to a predetermined fixed value for the duration of the TEST MODE operation. The digital value of TEST BRIGHTNESS corresponds to an analog voltage level. For example, TEST BRIGHTNESS may be set to +10 volts, which may correspond, for example, to a maximum brightness setting. Consequently, the analog voltage level of all COL outputs of level shifter and driver 328 feeding active-matrix display 305 are set according to TEST BRIGHTNESS.

Pixel address generator 316 supplies a unique COL and ROW address according to the location of a given pixel within active-matrix display 305. The COL addresses are provided as a steady-state level, while the ROW addresses are timed pulses. One cycle is executed and, thus, the OLED of only one pixel is turned on. For example and with reference to FIG. 1, if active-matrix array 100 is a portion of active-matrix display 305, when a given ROW is pulsed, a given switch transistor 112 transfers the voltage level (corresponding to a brightness level) present at a given COL select line to a given power transistor 114, and thereby turns on the selected OLED 118. The voltage level present at a given COL select line is also stored upon the corresponding capacitor 116. Having turned on the desired OLED 118, current sensor 330 measures the output current thereof via its corresponding POWER BUS connection. The output current measurement from current sensor 330 is digitized via A/D converter 332 and stored within memory 324.

In like manner, each pixel within active-matrix display 305 is activated sequentially and its output current measured one at a time, until the output current of all pixels has been measured and stored within memory 324. System controller 310 then reads the contents of memory 324 and executes an algorithm to determine which pixel within active-matrix display 305 supplied the lowest output current. The pixel associated with the lowest output current is established as the reference pixel. Given that the relationship of output current to the value of TEST BRIGHTNESS is known, system controller 310 then executes an algorithm to calculate an amount by which the brightness value for all pixels relative to the reference pixel is reduced, and thereby creates a "brightness offset" value, typically in the order of a few millivolts for each pixel location. System controller 310 then overwrites the contents of memory 324 with the calculated "brightness offset" value for each pixel location. Optionally, a second memory device (not shown) may be provided to store the "brightness offset" value, which allows the measured current values to remain stored in memory 324.

Under the control of system controller 310, brightness compensation system 300 is then switched to the DISPLAY MODE of operation, which places MPX 320 and MPX 322 in a state such that the source for the COL select signals, ROW signals, and brightness information that feeds level shifter and driver 328 is video formatter 318. When video formatter 318 is activated, picture and brightness information is received according to the VIDEO IN and SYNC signals that enter video formatter 318. However, the digital value representing the brightness information, i.e., OPERATING BRIGHTNESS, from video formatter 318 is adjusted by the "brightness offset" value from memory 324 via pixel adjust device 326, which performs an arithmetic function that provides an adjusted digital brightness value to level shifter and driver 328. Because memory 324 is addressed by the COL and ROW lines, as is active-matrix display 305, the brightness adjustment operation of pixel adjust device 326 occurs in real time, pixel-by-pixel. Level shifter and driver 328 applies an analog voltage that corresponds to the adjusted brightness level to the COL lines that feed active-matrix display 305. As a result, the brightness of each pixel within active-matrix display 305 is compensated, relative to the reference pixel, as determined in the TEST MODE of operation. In this way, uniform brightness is achieved from pixel-to-pixel across the full array.

Figure 4:
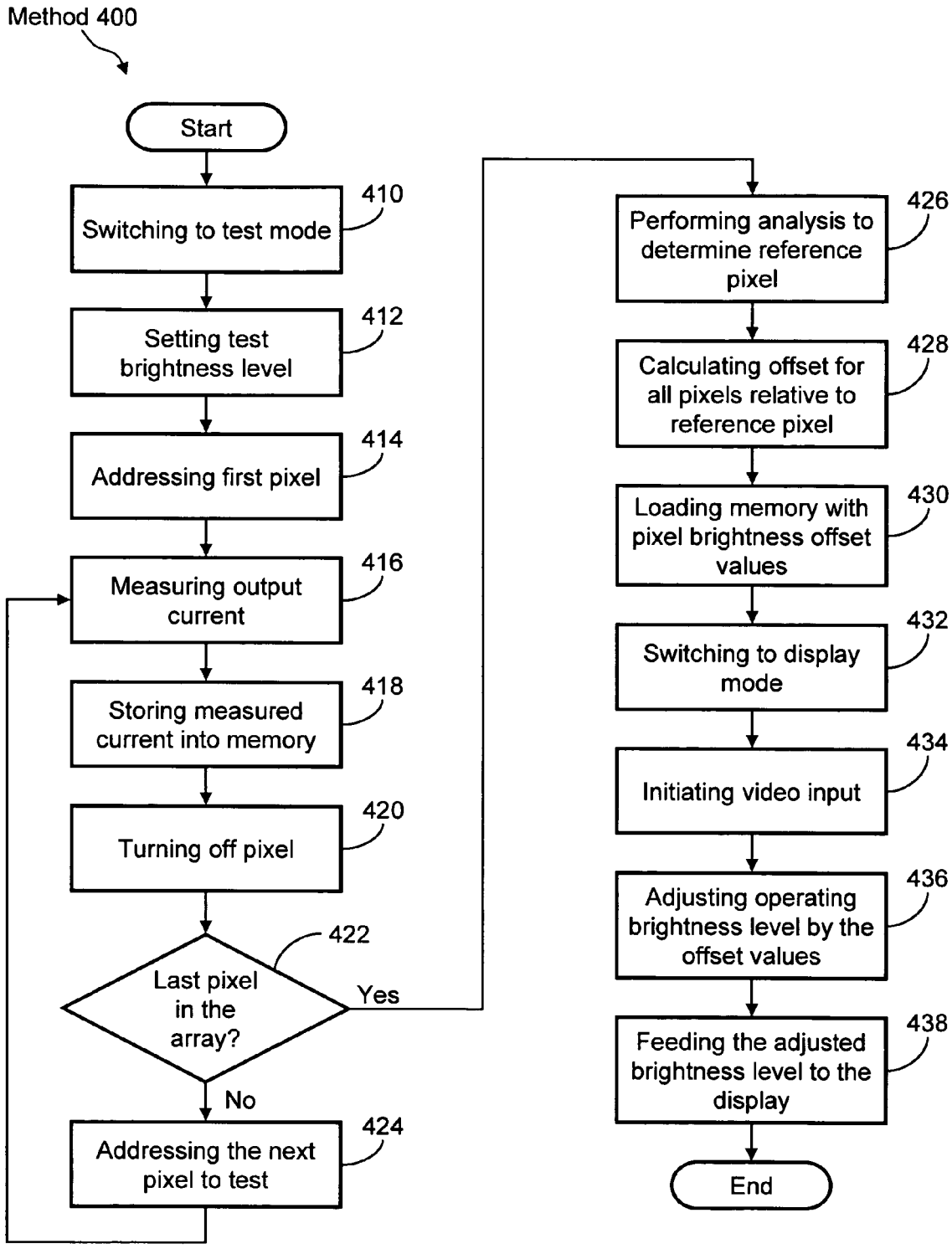
FIG. 4 illustrates a flow diagram of a method of compensating an active-matrix OLED display to achieve uniform brightness in accordance with the invention.

FIG. 4 illustrates a flow diagram of a method 400 of compensating an active-matrix OLED display to achieve uniform brightness in accordance with the invention. With continuing reference to FIGS. 1, 2, and 3, method 400 includes the following steps.

At step 410, system controller 310 switches brightness compensation system 300 to the TEST MODE of operation, which places MPX 320 and MPX 322 in a state such that the source for the COL and ROW signals that feed level shifter and driver 328 is pixel address generator 316, and the source for the brightness information that feeds level shifter and driver 328 is test brightness generator 314. System controller 310 executes a predetermined reset routine that turns off every pixel within active-matrix display 305.

At step 412, system controller 310 sets the value of TEST BRIGHTNESS from test brightness generator 314 to a predetermined fixed value for the duration of the TEST MODE operation. The digital value of TEST BRIGHTNESS corresponds to an analog voltage value in the range of, for example, +2 to +15 volts. For example, setting TEST BRIGHTNESS to +10 volts may correspond to a maximum expected brightness level. Alternatively, TEST BRIGHTNESS may be set to any intermediate voltage level that corresponds to an intermediate brightness level. Consequently, the analog voltage level of all COL outputs of level shifter and driver 328 that feed active-matrix display 305 are set according to TEST BRIGHTNESS.

At step 414, pixel address generator 316 supplies a unique COL and ROW address according to a first pixel location within active-matrix display 305. The COL addresses are provided as a steady-state level, while the ROW addresses are timed pulses. One cycle is executed and, thus, the OLED of only the first pixel is turned on.

At step 416, current sensor 330 measures the output current of the selected pixel via its corresponding POWER BUS connection.

At step 418, the output current measurement from current sensor 330 is subsequently digitized via A/D converter 332 and stored within memory 324.

At step 420, system controller 310 turns off the pixel under test by either turning off the individual pixel under test or by executing a predetermined reset routine that turns off every pixel within active-matrix display 305. Alternatively, the reset routine may be executed preceding a whole column of pixel tests.

At step 422, if system controller 310 in combination with pixel address generator 316 determines that the last pixel in the array has been activated and its output current measured and stored, method 400 proceeds to step 426. However, if system controller 310 in combination with pixel address generator 316 determines that the last pixel in the array has not yet been activated and its output current measured and stored, method 400 proceeds to step 424.

At step 424, pixel address generator 316 increments the COL and ROW address and thereby selects the next pixel. Method 400 returns to step 416.

At step 426, system controller 310 performs an analysis to determine the least performing pixel, which then becomes the reference. More specifically, system controller 310 reads the contents of memory 324 and executes an algorithm to determine which pixel within active-matrix display 305 supplied the lowest output current. The pixel associated with the lowest output current is established as the reference pixel.

At step 428, given that the relationship of output current to the value of TEST BRIGHTNESS is known, system controller 310 executes an algorithm to calculate an amount by which the brightness value for all pixels relative to the reference pixel is reduced and thereby creates a "brightness offset" value, typically in the order of a few millivolts for each pixel location.

At step 430, system controller 310 overwrites the contents of memory 324 with the calculated "brightness offset" value for each pixel location, as calculated at step 428.

At step 432, system controller 310 switches brightness compensation system 300 to the DISPLAY MODE of operation, which places MPX 320 and MPX 322 in a state such that the source for the COL select signals, ROW signals, and brightness information that feeds level shifter and driver 328 is video formatter 318.

At step 434, video formatter 318 is activated and, thus, its picture and brightness information are received according to the VIDEO IN and SYNC signals entering video formatter 318.

At step 436, the digital value that represents the brightness information from video formatter 318, i.e., OPERATING BRIGHTNESS, is adjusted by the "brightness offset" value from memory 324 via pixel adjust device 326, which performs an arithmetic function that provides an adjusted digital brightness value to level shifter and driver 328. Because memory 324 is addressed by the COLs and ROWs, as is active-matrix display 305, the brightness adjustment operation of pixel adjust device 326 occurs in real time, pixel-by-pixel.

At step 438, level shifter and driver 328 applies an analog voltage that corresponds to the adjusted brightness level to the COLs feeding active-matrix display 305. As a result, the brightness of each pixel within active-matrix display 305 is compensated, relative to the reference pixel, as determined at step 426. In this way, uniform brightness is achieved from pixel-to-pixel across the full array of active-matrix display 305.

Because brightness compensation system 300, with its measurement and corrective functions, is built into the display interface circuitry of active-matrix display 305, the corrective sequence of method 400, which may last as little as a few seconds, can be activated at any time, as required. For example, the corrective sequence of method 400 may be automatically activated every time the display power is cycled; or, alternatively, the corrective sequence of method 400 may be automatically activated on any desired time interval, such as weekly, daily, or hourly. Additionally, the corrective sequence of method 400 may be executed at various TEST BRIGHTNESS settings as desired.

Figure 5:
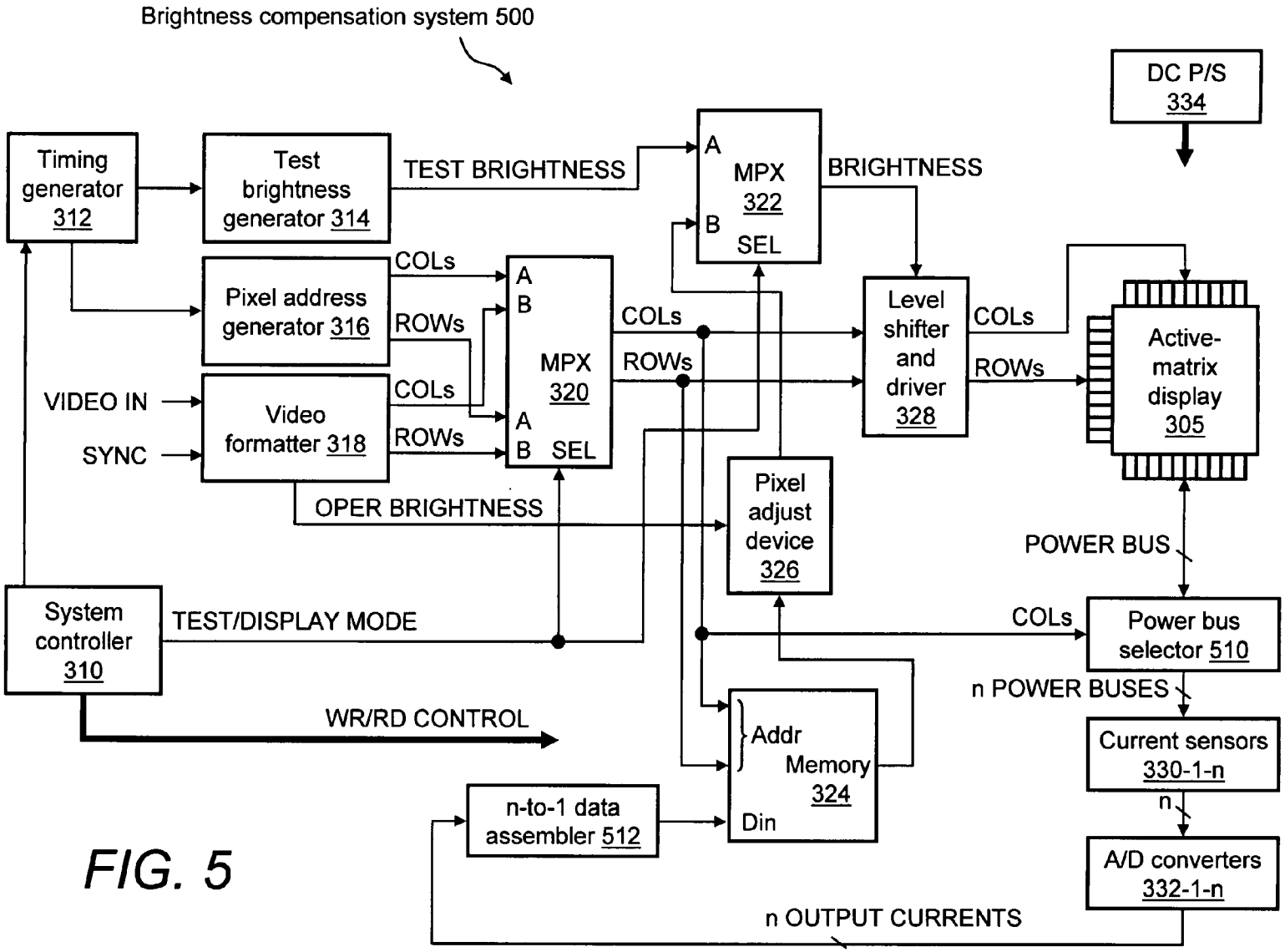
FIG. 5 illustrates a functional block diagram of a brightness compensation system for providing brightness uniformity within an active-matrix OLED flat-panel display in accordance with a second embodiment of the invention.

FIG. 5 illustrates a functional block diagram of a brightness compensation system 500 for providing brightness uniformity within an active-matrix OLED flat-panel display in accordance with a second embodiment of the invention. Brightness compensation system 500 illustrates a minimal set of additions to brightness compensation system 300 of FIG. 3, in order to accomplish "n-at-a-time" element or cell measurements.

More specifically, as compared with brightness compensation system 300 of FIG. 3, the time required to measure the corrections necessary to provide brightness uniformity to all of the active matrix elements (cells) of active-matrix display 305 are reduced by a factor "n", where "n" is the number of elemental columns being tested in parallel, a cell at a time. This is generally accomplished by including "n" current sensors, "n" A/D converters, multiplexing switches to select the group of "n" POWER BUSES, and a data signal source programmed to provide the proper test signal to the selected "n" columns under test. Because brightness compensation system 500 is able to test "n" cells in the same time required to test one cell with compensation system 300, the overall test time is reduced by a factor of "n", for example, 2, 3, 6, etc.

Brightness compensation system 500 includes active-matrix display 305, system controller 310, timing generator 312, test brightness generator 314, pixel address generator 316, video formatter 318, MPX 320, MPX 322, memory 324, pixel adjust device 326, level shifter and driver 328, and DC P/S 334, as described in more detail in reference to FIG. 3. However, brightness compensation system 500 further includes a power bus selector 510, which feeds a plurality of current sensors 330, i.e., current sensors 330-1 through **330-*n*, which feed a plurality of A/D converters 332, i.e., A/D converters 332-1 through 332-*n*, respectively, which feed an n-to-1 data assembler 512, which feeds the data input of memory 324. Each current sensor 330 and each A/D converter 332 is as described in reference to FIG. 3**.

Power bus selector 510 is a digital device that contains a set of multiplexing switches that are addressed by the column address lines, i.e., the COLs. In the TEST MODE of operation, power bus selector 510 is used for steering, cycle-by-cycle, the desired "n" POWER BUS lines, which are associated with "n" COLs, to current sensors 330-1 through 330-n. For example, if n=2, two POWER BUS lines are directed to the input of current sensor 330-1 and a current sensor 330-2, respectively, during any given test cycle. In each sequential test cycle, two unique POWER BUS lines are directed in real time to the input of current sensor 330-1 and a current sensor 330-2, based on the column address provided.

The n-to-1 data assembler 512 is a fast parallel-to-serial digital interface for inputting serialized data to memory 324. More specifically, n-to-1 data assembler 512 receives the parallel digital data from A/D converters 332-1 through **332-*n* and generates a serialized digital data stream to the data input of memory 324** for storage thereof.

Those skilled in the art will recognize that the general steps of compensating an active-matrix OLED display to achieve uniform brightness, as described in method 400 of FIG. 4, may be applied generally to brightness compensation system 500 and easily modified to include testing "n" cells at a time. More specifically, in the case of brightness compensation system 500, and under the control of system controller 310, pixel address generator 316 is programmed to enable "n" column and POWER BUS connections for each measurement event. After measurements have been made and recorded in memory 324, the selection of the strongest (or weakest) cell made, and the necessary corrections recorded (either in memory 324 or in a separate correction memory), the normal operation (DISPLAY MODE) of active-matrix display 305 will proceed in a line-at-a-time manner, as described in reference to FIG. 3, and in the normal manner of distributing picture element brightness data, which have been adjusted for achieving uniformity.

Although the invention has been described in detail in connection with the exemplary embodiments, it should be understood that the invention is not limited to the above disclosed embodiments. Rather, the invention can be modified to incorporate any number of variations, alternations, substitutions, or equivalent arrangements not heretofore described, but which are commensurate with the spirit and scope of the invention. Accordingly, the invention is not limited by the foregoing description or drawings, but is only limited by the scope of the appended claims.

The invention claimed is:

1. A brightness compensation system for providing brightness uniformity across a plurality of pixels of an active matrix display, comprising:

a pixel address generator for generating a set of unique column and row outputs, each unique column and row output respectively identifying a unique one of said plurality of pixels;

a test brightness generator for generating a digitized test brightness value which is individually applied to each one of said plurality of pixels in accordance with the output of said pixel address generator;

a current sensor for individually measuring the output current from each one of said plurality of pixels upon the application of said digitized test brightness value;

a controller for determining an offset amount by which the brightness value for each of said plurality of pixels must be adjusted relative a reference pixel, wherein the reference pixel is the pixel with the lowest or highest output current in response to the application of the digitized test brightness value; and a pixel adjust device for adjusting the brightness of each of said plurality of pixels in accordance with the offset amount determined by the controller to achieve an active matrix display of uniform brightness.

2. The brightness compensation system of claim 1, wherein the brightness compensation system is integral with the display interface circuitry of the active matrix display.

3. The brightness compensation system of claim 1, wherein said controller controls the mode of operation of the brightness compensation system between a test mode, in which said digitized test brightness value is individually applied to each one of said plurality of pixels and said offset amount for each pixel is determined, and a display mode, in which a video input signal is applied and the output of each of said plurality of pixels is individually adjusted by said offset amount to obtain an output of uniform brightness.

4. A brightness compensation system for an active matrix organic light-emitting display, comprising:

a system controller for controlling the mode of operation of the brightness compensation system between a plurality of modes including a test mode, in which a digitized test brightness value is individually applied to each one of a plurality of pixels of said active matrix display and said offset amount for each pixel is determined, and a display mode, in which a video input signal is applied and the output of each of said plurality of pixels is individually adjusted by said offset amount;

a pixel address generator for generating a set of unique column and row outputs, each unique column and row output respectively identifying a unique one of said plurality of pixels;

a test brightness generator for generating a digitized test brightness value which is individually applied to each one of said plurality of pixels in accordance with the output of said pixel address generator;

a timing generator for supplying timing signals to said test brightness generator and to said pixel address generator;

a controller for determining said offset amount by which the brightness value for each of said plurality of pixels must be adjusted relative a reference pixel, wherein the reference pixel is the pixel with the lowest or highest output current in response to the application of the digitized test brightness value; and a pixel adjust device for adjusting the brightness of each of said plurality of pixels in accordance with the offset amount determined by the controller to achieve an active matrix display of uniform brightness.

5. The brightness compensation system of claim 4, wherein the organic light-emitting display comprises a matrix of pixels, each pixel including an organic light-emitting diode.

6. A method of achieving uniform brightness across a plurality of pixels of an active matrix light-emitting display structure, comprising the steps of:

applying a digitized test brightness value individually to each one of a plurality of pixels of said light-emitting display structure;

measuring the output current from each one of said plurality of pixels individually upon the application of said digitized test brightness value;

determining the pixel with the lowest or highest output current in response to the application of the digitized test brightness value and establishing that pixel as a reference pixel;

determining an offset amount by which the brightness value for each of said plurality of pixels must be adjusted relative said reference pixel; and adjusting the brightness of each of said plurality of pixels in accordance with the determined offset amount to achieve an active matrix display of uniform brightness.

7. The method of claim 6, wherein the steps of applying a digitized test brightness value, measuring the output current from each one of said plurality of pixels, and determining an offset amount for each pixel are performed in a test mode of operation, and said step of adjusting the brightness of each of said plurality of pixels is performed in a display mode of operation.

8. The method of claim 6, wherein the step of determining an offset amount is performed by:

executing an algorithm to calculate an amount by which the brightness value of all other pixels relative to the reference pixel must be reduced or increased to achieve a uniform brightness, thereby creating said offset amount for each pixel.

9. The method of claim 7, wherein testing of the pixels in the test mode of operation is performed sequentially, pixel by pixel.

10. The method of claim 7, wherein testing of the pixels in the test mode of operation is performed simultaneously, column by column.

* * * * *